United States Patent [19]

Fröidh et al.

[11] 4,342,562

[45] Aug. 3, 1982

[54] PACKAGE AND METHOD AND APPARATUS FOR MANUFACTURING THE SAME

[75] Inventors: Tor A. Fröidh, Stenungsund; Leif U. R. Widlund, Mölnlycke, both of Sweden

[73] Assignee: Molnlycke Aktiebolag, Sweden

[21] Appl. No.: 102,659

[22] Filed: Dec. 12, 1979

[30] Foreign Application Priority Data

Dec. 21, 1978 [SE] Sweden ..... 7813176

[51] Int. Cl.[3] ..... B31B 3/26

[52] U.S. Cl. ..... 493/124; 493/112; 493/126; 493/156; 493/176; 493/308

[58] Field of Search ..... 493/308, 176, 126, 127, 493/123, 156, 157, 175, 143, 472, 112

[56] References Cited

U.S. PATENT DOCUMENTS

| | | | |
|---|---|---|---|
| 2,446,798 | 8/1948 | Vergobbi | 493/473 |
| 2,642,785 | 6/1953 | Wittkuhns et al. | 493/472 X |
| 2,761,611 | 9/1956 | Benschoter | 229/37 R |
| 2,971,442 | 2/1961 | Engleson et al. | 493/472 X |
| 3,196,759 | 7/1965 | Palmer et al. . | |
| 3,951,330 | 4/1976 | Desmond | 229/38 |

*Primary Examiner*—Horace M. Culver

*Attorney, Agent, or Firm*—Lerner, David, Littenberg & Samuel

[57] ABSTRACT

A method and apparatus for manufacturing a package from a package blank which includes a series of lateral surfaces and end wall sections connected by fold lines are disclosed. The method disclosed includes folding the package blank along fold lines between the lateral surfaces, moving such partially formed package blank along a predetermined path, and rotating the package blank while it is moving along that path while at the same time sequentially folding the end wall sections along a second set of fold lines at one end of the package so as to form an end wall surface at that end. The apparatus disclosed includes forming means for forming the package blank into a partially folded package including lateral surfaces, the forming means including rotating means for rotating the forming means, moving means for moving the package along a predetermined path, and folding means for sequentially folding end wall sections at one end of the package as the package blank is moving along the predetermined path in order to form end wall surface for the package.

12 Claims, 7 Drawing Figures

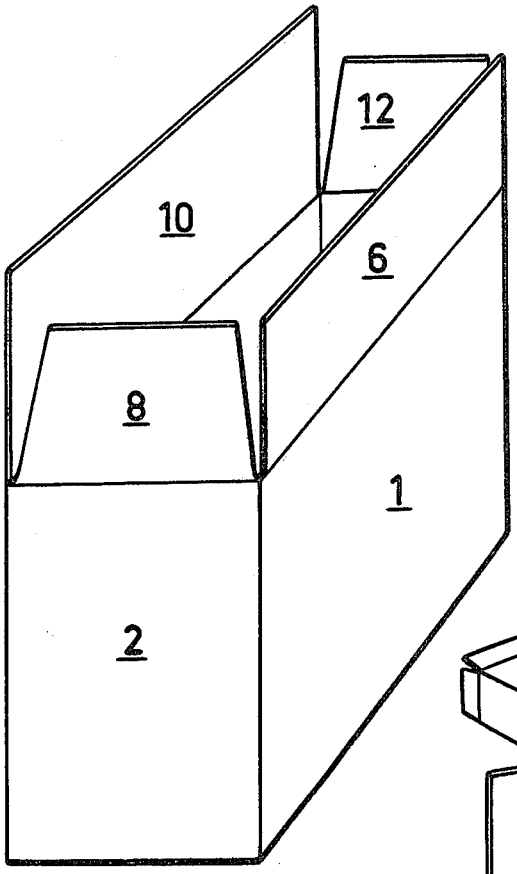
FIG.3
FIG.7
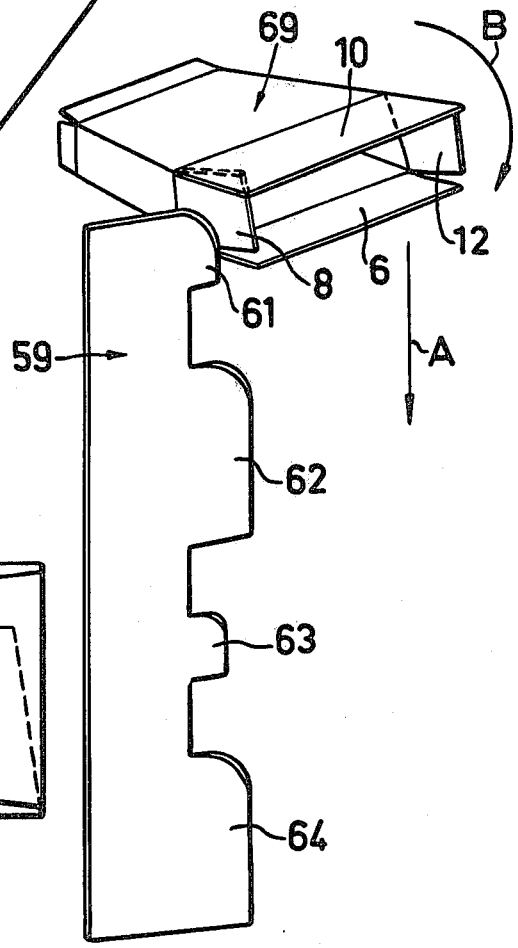
FIG.4
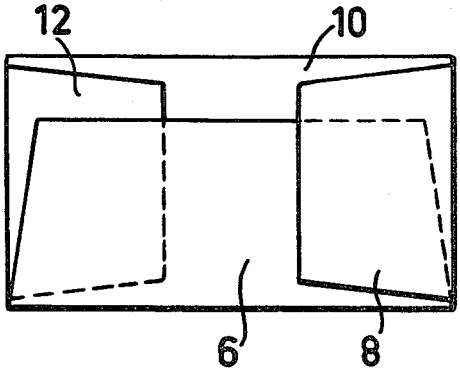

PACKAGE AND METHOD AND APPARATUS FOR MANUFACTURING THE SAME

FIELD OF THE INVENTION

The present invention relates to methods for producing a package from a package blank consisting of side or lateral surfaces and end wall surfaces. More particularly, the present invention relates to methods for producing such packages in which the end wall surfaces are formed of tips which are coherent with the side of lateral surfaces. The present invention also relates to apparatus for manufacturing such packages.

BACKGROUND OF THE INVENTION

The manufacture of packages which include both lateral surfaces and end wall surfaces coherent therewith is both relatively complicated and requires large and expensive installations, primarily because the blanks for the packages in conventional package making machines must be continuously fed past different folding devices, some of which perform complicated movements so as to fold or raise the blanks into package form. A primary object of the present invention is to provide a novel method and apparatus for producing a package of that kind which can be manufactured in a simple and low cost apparatus.

SUMMARY OF THE INVENTION

In accordance with the present invention, a method has now been discovered which renders it possible to manufacture a package from a blank which includes both side or lateral surfaces and end wall surfaces coherent therewith, i.e. in a one piece blank, from a blank formed of paper, cardboard, plastic or other such similar materials, where the lateral and end wall surfaces are coherent over fold lines and are intended, in their raised or folded state, to form the lateral and end wall surfaces of the formed package.

According to the method of the present invention, a package is formed from a package blank including a plurality of adjacent lateral surfaces intended to form the lateral surfaces of the package and a plurality of adjacent end wall sections intended to form at least one end wall surface of the package, each of the end wall sections being associated with one of the lateral surfaces, each of the adjacent lateral surfaces being defined by a first set of fold lines with respect to its adjacent lateral surface, and each of the end wall sections being defined by a second set of fold lines with respect to its associated lateral surface, the method specifically comprising folding the package blank along the first set of fold lines in order to form a partially folded package including such lateral surfaces, moving the package blank along a predetermined path, and rotating the package blank while it is moving along that predetermined path while at the same time sequentially folding the end wall sections at one end of the package along the second set of fold lines in order to form an end wall surface for the package.

In a preferred embodiment of the method of the present invention, the package is subsequently filled, and then moved along another predetermined path, and the method includes rotating the filled package while it is moving along that path while at the same time sequentially folding the end wall sections at the other end of the package along the second set of fold lines in order to form a second end wall surface for the package.

In another embodiment of the present invention, the package blank is folded along the first set of fold lines by applying that blank to the surface of a rotating shaping member which includes a plurality of surfaces which coincide with the plurality of lateral surfaces of the package blank.

The package blank folded in accordance with this method is either folded along the first set of fold lines while the blank is moving along the predetermined path or prior to moving the package along the predetermined path.

In a preferred embodiment of the method of this invention, a binder coat is applied to predetermined locations on the package blank so that during that method the package blank is jointed at locations where portions of the package blank overlap with said binder coat therebetween. Preferably, the package blanks are supplied from a continuous web and the blanks are cut from that web. Preferably, the binder coat employed comprises a hot melt adhesive.

In accordance with the apparatus of the present invention, packages are manufactured from the aforementioned package blanks with an apparatus comprising forming means for forming the package blank into a partially folded package including lateral surfaces by folding along the first set of fold lines, the forming means including rotating means for rotating the forming means, moving means for moving the package blank along a predetermined path, and folding means for sequentially folding at least a portion of the end wall sections along a second set of fold lines at one end of the package as the package blank is moving along the predetermined path in order to form an end wall surface for the package.

In a preferred embodiment of the apparatus of this invention, the folding means includes a plurality of arms located adjacent to the predetermined path and projecting in a direction transverse thereto.

In another preferred embodiment of the apparatus of the present invention, the forming means comprises a male die member which is adapted to accept a leading edge of the package blank and which includes a plurality of surfaces corresponding with the lateral surfaces of the package blank so that the package blank can be formed into the partially folded package by folding the package blank over the surfaces of the male die member.

In accordance with another preferred embodiment of the apparatus of the present invention, the rotating means is adapted to rotate the forming means in order to form the package blank into a partially folded package either before the moving means moves the package along the predetermined path or while the moving means is moving the package along the predetermined path.

In another preferred embodiment of the apparatus of this invention, the apparatus includes transfer means for removing the package from the male die member, and the transfer means preferably comprises a female die member including an interior die surface which has a shape which conforms to the shape of the partially folded package blank including the first end wall surface. The transfer means also preferably includes suction means for transferring the partially folded package from the male die member to the female die member.

In accordance with another embodiment of the apparatus of the present invention, second folding means are provided for sequentially folding the end wall sections at the other end of the package as the package blank is moving along a second predetermined path in order to form a second end wall surface for the package. Preferably, female die member moving means are also provided for moving the package blank along the second predetermined path and the transfer means includes female die member rotating means for rotating that female die member.

BRIEF DESCRIPTION OF THE DRAWINGS

The present invention is further described in greater detail below by way of suitable embodiments and with reference to the accompanying drawings, in which:

FIG. 3 is a front perspective elevational view of a partially folded package produced in accordance with the method and apparatus of the present invention;

FIG. 4 is a bottom elevational view of the inside of an end wall surface of a package produced in accordance with the method and apparatus of the present invention;

FIG. 7 is a side elevational perspective view schematically showing the formation of an end wall surface of a package manufactured in accordance with the method and apparatus of the present invention including a portion of the apparatus thereof.

DETAILED DESCRIPTION

Figure 1:
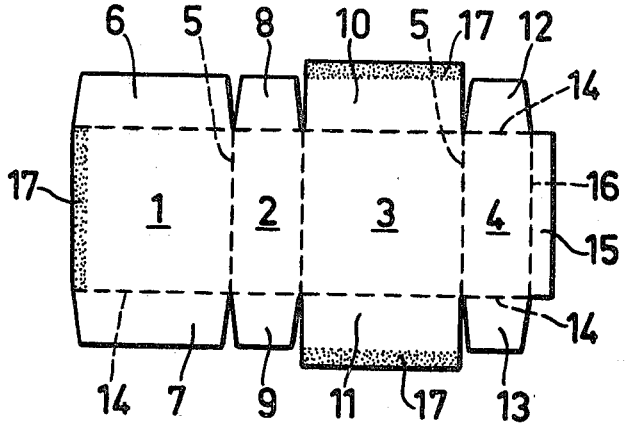
FIG. 1 is a top elevational view of a flattened package blank for use in the method and apparatus of the present invention.

The package blank shown in FIG. 1 has four lateral surfaces 1, 2, 3 and 4, which are defined relative to each other by a set of fold lines 5, and are provided at both ends with projecting tips or end wall sections 6–13, which are defined from the lateral surfaces by another set of fold lines 14. At one of the two outer lateral surfaces 4 an attachment tip 15 is located, which is defined relative to the lateral surface 4 by a fold line 16.

For making a package according to this invention, the package blank is first folded along the fold lines 5 and 16, whereafter the attachment tip 15 is connected to the lateral surface 1. Thereafter, end wall sections 6–13 are folded inward one over the other in the manner described below for producing an end wall surface of the package. For this reason the package blank is provided with binder strips 17.

Figure 2:
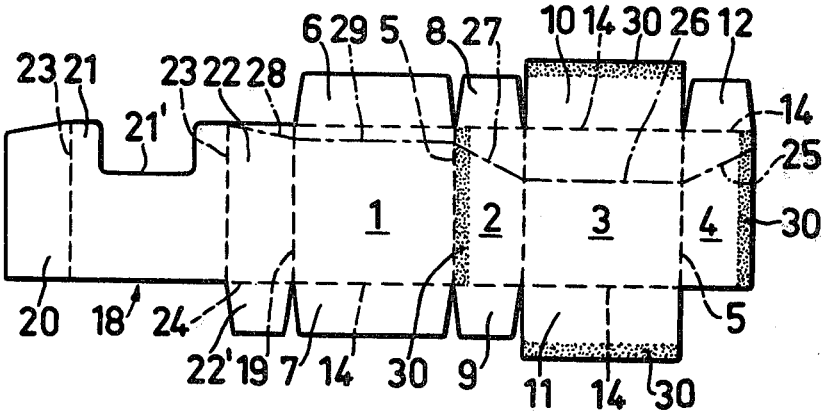
FIG. 2 is a top elevational view of another flattened package blank for use in the method and apparatus of this invention.

Referring next to FIG. 2, the package blank details corresponding to those shown in FIG. 1 have the same reference numerals as in FIG. 1. Compared with the package blank shown in FIG. 1, however, this package blank (according to FIG. 2) does not have either the attachment tip or one of the end tips on the lateral surface 4 as is the case in the package blank shown in FIG. 1. Instead, the lateral surface 1 is connected to a collar, designated in its entirety as 18. This collar 18 is defined from the lateral surface 1 by a fold line 19, and consists of three areas 20–22, which are defined relative to each other by fold lines 23. The area 22 is provided with an end tip 22′, which is defined with respect to the area 22 by a fold line 24. The blank is further provided with perforation lines 25–28 and a fold line 29.

In order to manufacture a package from the package blank shown in FIG. 7, collar 18 is first folded so that its central area 21 is located directly in front of the most closely adjacent lateral surface 1. The remaining lateral surfaces, 2–4, are thereafter folded along the set of fold lines 14 about collar 18 so as to each cover one of the areas 20–22 of the collar 18. The end tips or end wall sections 6–12 and 22′ are then folded inward one over the other to form an end wall surface of the package. The package blank is provided with binder strips 30 for various surfaces, and for retaining the attaching end wall sections to each other.

When such a package is to be opened, this can be effected along perforation lines 25–28 whereby a cover is formed which is hinged about a fold line 29. After having been opened, that cover can be locked again by the portions on both sides of a recess 21′ in the area 21 of the collar 18 serving as a locking means.

Referring to FIG. 3, a partially folded or raised package produced according to this invention is shown, with an open end wall surface. The end wall sections are to be folded inward over each other either in the sequential order 8, 6, 12 and 10 or in the sequential order 12, 6, 8 and 10, and then the inside of the resulting end wall surface assumes the appearance shown in FIG. 4. One of the end tips 10 is longer and slightly wider than the remaining ones, and in its inward folded state this covers the entire end wall surface of the package.

Figure 5:
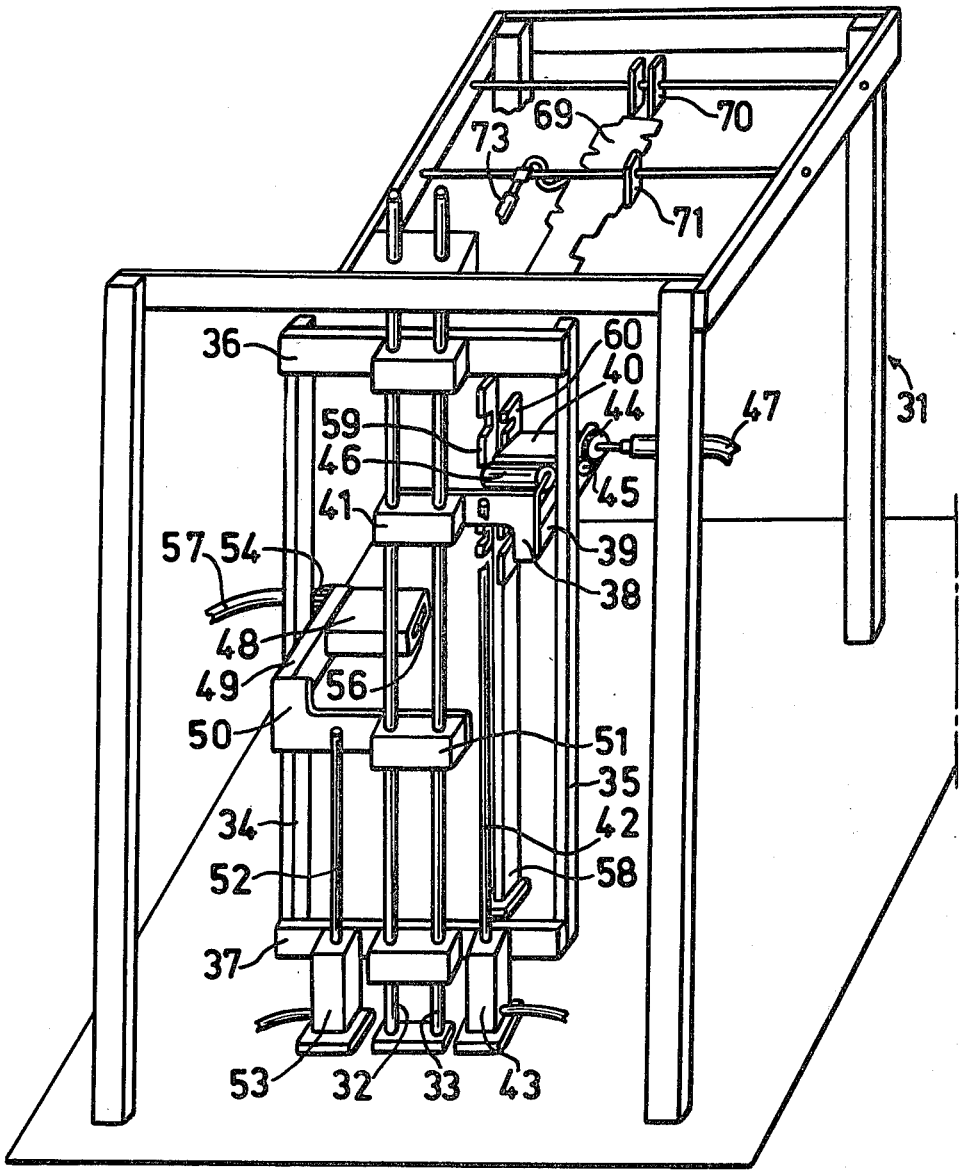
FIG. 5 is a front perspective view, partially schematic, view of the apparatus of the present invention.
Figure 6:
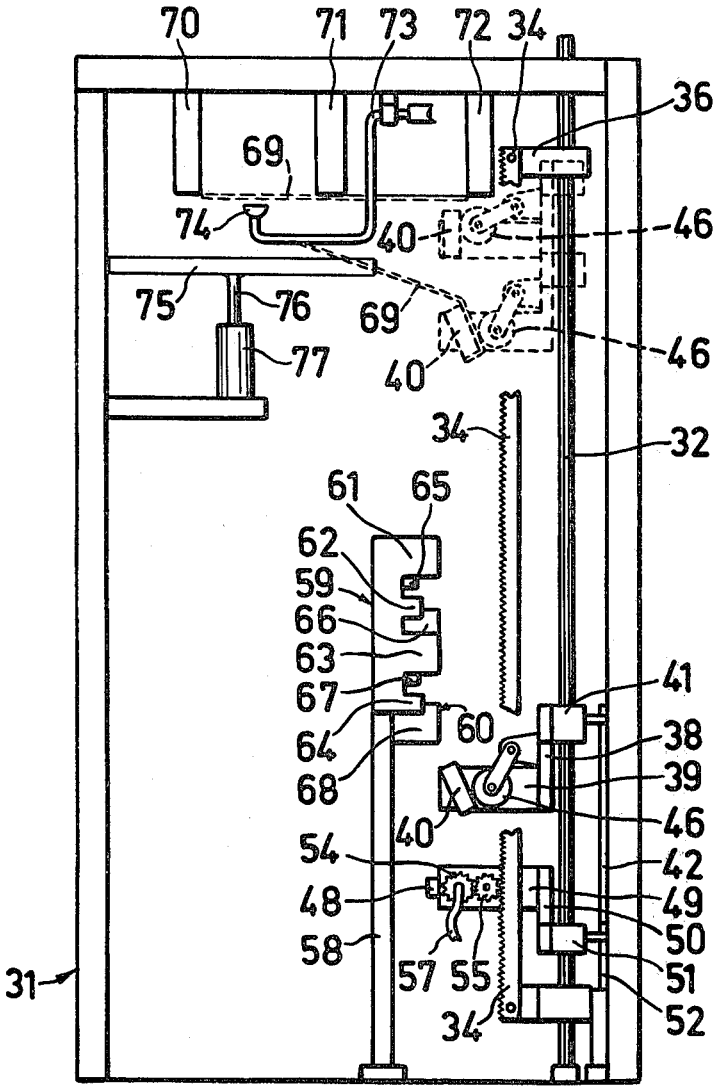
FIG. 6 is a side elevational partial view of the apparatus shown in FIG. 5.

As can be seen from FIGS. 5 and 6, apparatus according to this invention for raising or folding package blanks such as those shown in FIG. 2 comprises a stand, which in its entirety is designated 31. Two guide rods 32 and 33 extend vertically upward from a support and are rigidly attached to the upper end of the stand. These guide rods carry two vertical racks, 34 and 35, which are interconnected by transverse bars 36 and 37. A male die member 40 is connected by means of two supporting arms, 38 and 39, to a block member 41 which is movable along the guide rods, 32 and 33. The upper end of piston rod 42 for a pressure cylinder 43 is rigidly attached to supporting arm 38.

Male die member 40 is rigidly connected to a gear wheel 44, which meshes with an additional gear wheel 45, which in turn meshes with rack 35. When piston rod 42 is lifted or lowered by pressure cylinder 43, the male die member 40 is moved vertically and is simultaneously rotated about its geometrical axis. On supporting arm 38 a roller 46 is attached and resiliently pressed against male die member 40. That male die member is provided with a plurality of channels (not shown), which open on the surface of the member and are connected by a conduit 47 to a pressure source (not shown).

A female die member 48 is connected by means of two supporting arms, 49 and 50, to a second block member 51 movable along the guide rods 32 and 33. The upper end of piston rod 52 for pressure cylinder 53 is rigidly connected to supporting arm 50.

A female die member 48 is further rigidly connected to a gear wheel 54, which meshes with an additional gear wheel 55 (see FIG. 6), which in turn meshes with rack 34. When piston road 52 is lifted or lowered by means of the pressure cylinder, the female die member 48 is moved vertically, and is simultaneously rotated due to the meshing engagement of gear wheels 54 and 55 with rack 34.

The female die member is provided with a central interior space, 56, which, as will be described below, is intended to receive the package blank therein and is connected by a conduit 57 to a pressure source (not shown).

Between the male die member 40 and the female die member 48 two folding devices, 59 and 60, are mounted on an upright 58 and are provided with four transverse arms, 61 to 64, and, respectively, 65 to 68. The package blanks 69 are stacked upon each other in a magazine at the upper end of the stand. The package blanks rest on tongues (not shown) projecting from arms 70 and 72 in the magazine.

The apparatus according to the present invention comprises a conduit 73, which is connected to a vacuum source (not shown), the other end of which 74 (see FIG. 6) opens beneath the package blanks 69 in the magazine.

The apparatus according to this invention operates as follows.

The male die member 40 is moved by the piston rod 42 to the upper position shown by dashed lines in FIG. 6. In this position, one side of the male die member abuts the lower surface of the package blank 69. When the male die member contacts the package blank 69 in the magazine, the pressure source connected to conduit 47 is actuated so that a vacuum is created in conduit 47, and thereby also in the channels (not shown) of the male die member. Simultaneously, a vacuum is created in conduit 73 opening beneath the magazine. The lower package blank 69 in the magazine is thereby sucked out of the magazine, and by such sucking action is retained with one end proximate to the male die member 40.

When the male die member is lifted to its upper position, the two racks, 34 and 35, are taken along at the end of said movement, so that the male die member does not rotate when a package blank is positioned against that member. In this way it is insured that the male die member always meets a package blank with its side surface turned towards the member, and it always meets the package blank at the intended location. This is important in view of the winding of the package blank on the male member which takes place thereafter.

When the male die member 40 has drawn a package blank 69 from the magazine, that member is moved by the piston rod 42, and thereby caused to rotate again. In FIG. 6 the male die member is shown by dashed lines in a further position, which is located a distance beneath the upper position. As appears from that Figure, the package blank is wound about the male die member while that member rotates. The roller 46 resiliently abutting the male die member thereby presses the gradually folded package blank against the male die member. When the male die member reaches the area of the folding device 60, the package blank 69 is completely wound about the male die member to form the four lateral surfaces of the package. When the folding device is being passed, the end wall sections coherent with the lateral surfaces are folded inward to form one end wall surface of the package. This will be described in greater detail in the following with reference to FIG. 7. The male die member is then moved further downward past the additional position shown in FIG. 6 to a position directly in front of the female die member 48. When the male die member has reached that position, the pressure source, to which the conduit 47 is connected, is caused to yield an overpressure in conduit 47. At the same time, a vacuum is created in conduit 57, and thereby also in the interior space 56 of the female die member. The resultant pressure difference between the conduits, 47 and 57, then acts upon the package and moves it from the male die member into the interior space, 56, of the female die member, 48. The female die member can thereafter be moved downward a predetermined distance by means of piston rod 52, i.e. to a charging position (not shown) for goods with which the package is to be filled. When the package is filled, it is moved upward while remaining in the interior space of the female die member, and passes the folding device 59 while at the same time it is rotating. This, in turn, results in the folding of the projecting end wall sections inward at the open end of the package so as to close them. The female die member 48 then is moved to a discharge position for the closed package, and thereafter returns to the position shown in the drawing. The described procedure thereafter is repeated for the manufacture of additional packages.

The embodiment of an apparatus according to the invention shown in FIG. 5 also includes a pasting device, which is intended to apply a binder to the package blanks 69 stored in the magazine. This pasting device, which is not described here in detail, comprises a.o. a piston rod 76 for a pressure cylinder 77, which is intended to move a binder transfer member 75 into and out of contact with the lowermost package blank stored in the magazine in order to transfer the binder thereto.

It can be seen in FIG. 7 how the end wall sections 8, 6, 12 and 10 are folded inward, one above the other, in order to form an end wall surface of the package according to this invention. The package blank is moved in the direction of arrow A past the folding device 59, and simultaneously is rotated in the direction of arrow B. The end wall section 8 is folded inward by arm 61, and when this end wall section has been completely folded inward, and arm 61, due to movement of the package blank, is no longer engaged with the package, the inward folding of the next end wall section 6, by arm 62, begins. This next end wall section 12 is then folded in the same manner over the prior end wall section 61 in this case by arm 63 and, finally, end wall section 10 is folded inward over the prior end wall section 12 by arm 64.

The invention is not restricted to the embodiments described above, but it can be modified in several ways within the scope of the claims. The apparatus, for example, can be arranged to manufacture packages from blanks folded together in flat state, consisting of four jointed circumferential surfaces, which are intended, in the raised or folded state of the package blank, to form lateral surfaces of the package, and of end tips or wall sections extending from both ends of the lateral surfaces. In the magazine means are preferably provided for raising the package blanks. The raised package blanks then are attached to a male die member, which is moved along a path past a folding device, and is simultaneously rotated to form an end wall surface for the package, whereafter the package blank is inserted into a female die member, which when the package has been filled is moved along a second path past a second folding device for closing the package and bringing about a second end wall surface thereon.

The male and female die members need not be movable along a rectilinear path, but they may instead be movable along a curved path and, for example, be located on a rotatable member, which runs concentrically about an inner stationary member, the outer circumference of which is provided with driving cogs, which upon rotation of the outer member by means of gear wheels impart to the male and female die members the necessary rotational movements. When a plurality of male and female die members are arranged equally spaced along the circumference of the rotary member, an apparatus according to this embodiment of the invention will have a very high capacity.

The package blanks, of course, need not be arranged in a stack, or in a magazine of the kind here described, but they may also be advanced, for example, in the form of a coherent web from a supply roll.

The roller 46 for pressing the blank against the male member could be substituted for a resilient web or band with its extension in the direction of the movement of the male member, and arranged in such a way that the web or package band, during the movement of the male die member, is pressed against the same.

We claim:

1. A method of manufacturing a package from a package blank including a plurality of adjacent lateral surfaces intended to form the lateral surfaces of said package and a plurality of adjacent end wall sections intended to form at least one end wall surface of said package, each of said end wall sections being associated with one of said plurality of lateral surfaces, each of said adjacent lateral surfaces being defined by a first set of fold lines with respect to its adjacent lateral surface, and each of said end wall sections being defined by a second set of fold lines with respect to the lateral surface with which it is associated, said method comprising folding said package blank along said first set of fold lines by applying said package blank to the surface of a rotating shaping member including a plurality of surfaces coinciding with said plurality of lateral surfaces of said package so as to form a partially folded package including said lateral surfaces, moving said package blank along a predetermined path, and rotating said package blank by means of said rotating shaping member while it is moving along said predetermined path while at the same time sequentially folding said end wall section along said second set of fold lines at one end of said package by sequentially contacting said end wall sections with a plurality of stationary arms located adjacent to said predetermined path and projecting in a direction transverse to said predetermined path so as to form an end wall surface for said package.

2. The method of claim 1 wherein said package blank is folded along said first set of fold lines so as to form said partially folded package while said package blank is moving along said predetermined path.

3. The method of claim 1 wherein said package blank is folded along said first set of fold lines so as to form said partially folded package prior to moving said package blank along said predetermined path.

4. Apparatus for manufacturing a package from a package blank including a plurality of adjacent lateral surfaces intended to form the lateral surfaces of said package and a plurality of adjacent end wall sections intended to form at least one end wall surface of said package, each of said end wall sections being associated with one of said plurality of lateral surfaces, each of said adjacent lateral surfaces being defined by a first set of fold lines with respect to its adjacent lateral surface, and each of said end wall sections being defined by a second set of fold lines with respect to said lateral surface with which it is associated, said apparatus comprising forming means for forming said package blank into a partially folded package including said lateral surfaces by folding said package blank along said first set of fold lines, said forming means including a male die member adapted to accept a leading edge of said package blank and including a plurality of surfaces corresponding with the lateral surfaces of said package blank so that the package blank can be formed into said partially folded package by folding said package blank over the surfaces of said male die member, rotating means for rotating said forming means, moving means for moving said package blank along a predetermined path, and folding means comprising a plurality of arms located adjacent to said predetermined path and projecting in a direction transverse to said predetermined path for sequentially folding at least a portion of said end wall sections along said second set of fold lines at one end of said package as said package blank is moving along said predetermined path so as to form an end wall surface for said package.

5. The apparatus of claim 4 including transfer means for removing said package including said end wall surface from said male die member.

6. The apparatus of claim 5 wherein said transfer means comprises a female die member including an interior die surface having a shape conforming to the shape of said partially formed package blank including said end wall surface.

7. The apparatus of claim 6 wherein said transfer means includes suction means for transfering said partially folded package blank including said end wall surface from said male die member to said female die member.

8. The apparatus of claim 5 wherein said predetermined path comprises a first predetermined path, and including female die member moving means for moving said package blank along a second predetermined path, and wherein said transfer means includes female die member rotating means for rotating said female die member.

9. The apparatus of claim 8 wherein said end wall surface of said package comprises a first end wall surface, and said folding means comprises first folding means, and including second folding means for sequentially folding a further plurality of said end wall sections along said second set of fold lines at a second end of said package as said package blank is moving along said second predetermined path so as to form a second end wall surface for said package.

10. The apparatus of claim 8 or 9 wherein said second folding means comprises a plurality of arms located adjacent to said second predetermined path and projecting in a direction transverse to said predetermined path.

11. The apparatus of claim 4 wherein said rotating means is adapted to rotate said forming means so as to form said package blank into a partially folded package before said moving means moves said package blank along said predetermined path.

12. The apparatus of claim 4 wherein said rotating means is adapted to rotate said forming means so as to form said package blank into a partially folded package while said moving means is moving said package blank along said predetermined path.

* * * * *